US011162512B2

(12) United States Patent
Shimada

(10) Patent No.: US 11,162,512 B2
(45) Date of Patent: Nov. 2, 2021

(54) AXIAL-FLOW FAN

(71) Applicant: T.RAD Co., Ltd., Tokyo (JP)

(72) Inventor: Kota Shimada, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 158 days.

(21) Appl. No.: 16/591,898

(22) Filed: Oct. 3, 2019

(65) Prior Publication Data

US 2020/0116162 A1 Apr. 16, 2020

(30) Foreign Application Priority Data

Oct. 12, 2018 (JP) ..... JP2018-193501

(51) Int. Cl.
*F04D 29/58* (2006.01)
*F04D 19/00* (2006.01)
*F04D 29/053* (2006.01)

(52) U.S. Cl.
CPC ..... *F04D 29/582* (2013.01); *F04D 19/002* (2013.01); *F04D 29/053* (2013.01)

(58) Field of Classification Search
CPC ..... F04D 29/582; F04D 19/002; F04D 29/053
See application file for complete search history.

(56) References Cited

U.S. PATENT DOCUMENTS

2017/0184125 A1* 6/2017 Matsui ..... F04D 29/542
2017/0342991 A1* 11/2017 Zhang ..... F04D 25/0613
2018/0195526 A1* 7/2018 Hakozaki ..... F04D 19/007
2018/0266426 A1* 9/2018 Lee ..... F04D 29/5806
2019/0093669 A1* 3/2019 Inouchi ..... F04D 29/545
2019/0285076 A1* 9/2019 Okuda ..... F04D 25/082

FOREIGN PATENT DOCUMENTS

JP 2000199497 A * 7/2000
JP 2006-129601 A 5/2006

* cited by examiner

*Primary Examiner* — Aaron R Eastman
(74) *Attorney, Agent, or Firm* — Norris McLaughlin, P.A.

(57) ABSTRACT

An axial-flow fan includes a fan motor provided with a projecting rotary shaft, and a fan having a bowl-like shaped boss part to be fitted over an end part on a rotary shaft side of the fan motor via a space and having many fan blades projected in a radial pattern on an outer periphery of the boss part, in which a plurality of air holes are formed in a shaft line direction of the rotary shaft, adjacently to the rotary shaft and intensively in a central portion of the boss part; a blade air current is generated in one direction of the shaft line by the many fan blades; and a central portion air current is formed by discharging air passing through an inside of the space in the other direction of the shaft line through the air hole. Then, the rotary shaft is cooled with the central portion air current.

4 Claims, 7 Drawing Sheets

Fig. 5A

EXPERIMENTS FOR COMPARING RISE IN TEMPERATURE IN SEAL PLATE WITHOUT HOLE AND IN SEAL PLATE WITH HOLES (80°C)

| TEMPERATURE 80°C | WITHOUT HOLE | WITH HOLES | TEMPERATURE DIFFERENCE |
|---|---|---|---|
| BRUSH 1 | 171.4 | 160.4 | -11.0 |
| BRUSH 2 | 170.7 | 158.8 | -11.9 |
| BRUSH 3 | 168.6 | 158.7 | -9.9 |
| BRUSH 4 | 170.1 | 159.7 | -10.4 |
| FRONT END BEARING | 137.2 | 126.5 | -10.7 |
| REAR END BEARING | 119.9 | 111.8 | -8.1 |

EXPERIMENTS FOR COMPARING RISE IN TEMPERATURE IN SEAL PLATE WITHOUT HOLE AND IN SEAL PLATE WITH HOLES (90°C)

| TEMPERATURE 90°C | WITHOUT HOLE | WITH HOLES | TEMPERATURE DIFFERENCE |
|---|---|---|---|
| BRUSH 1 | 179.0 | 173.0 | -6.0 |
| BRUSH 2 | 178.7 | 172.7 | -6.0 |
| BRUSH 3 | 178.6 | 172.9 | -5.7 |
| BRUSH 4 | 178.9 | 172.9 | -6.0 |
| FRONT END BEARING | 145.9 | 138.9 | -7.0 |
| REAR END BEARING | 129.6 | 126.9 | -2.7 |

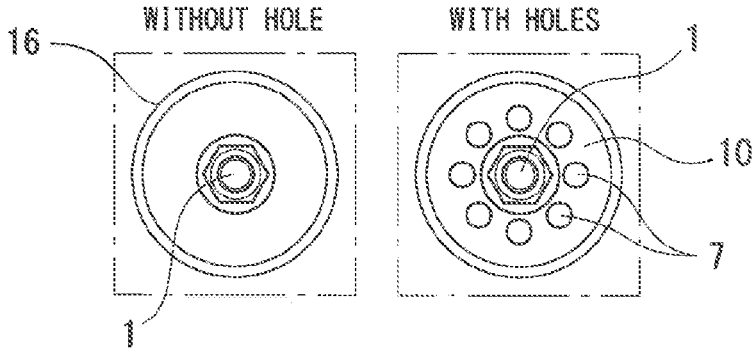

Fig. 5B Fig. 5C

AXIAL-FLOW FAN

BACKGROUND OF THE INVENTION

Field of the Invention

The present invention relates to an axial-flow fan for blowing air mainly for a heat exchanger.

Description of the Related Art

An axial-flow fan is used for a heat exchanger used for a radiator or cooling in automobiles, and a fan motor is used for a driving source of the axial-flow fan. A casing of this fan motor is fixed in an engine room, and a boss part of the fan is connected with a rotary shaft of the motor. Many fan blades are fixed on the outer periphery of this boss part, and, by rotating the fan, fan blades send air to the heat exchanger side to thereby perform heat exchange.

In a fan motor described in Japanese Patent Laid-Open No. 2006-129601 (Patent Literature 1) below, a plurality of boss holes are opened in a corner of a joint of the fan blade and the boss part, and air passing between the fan motor and the boss part of the fan is discharged along a plane of the blade to thereby cool the motor.

SUMMARY OF THE INVENTION

In the fan motor described in above Patent Literature 1, a plurality of boss holes are opened in a radial pattern between a periphery edge of a boss part plane and a joint of a fan blade, and air lying near the outer periphery of the fan motor is discharged parallel to the blade, utilizing a negative pressure on a blade negative pressure face side of the fan blade.

However, according to experiments of the present inventor, it was found that parts resulting in the highest temperature in a fan motor were a rotary shaft, bearings in connection with it and a brush for power supply inside the motor. Thus, it has been made clear that, as a consequence of cooling a rotary shaft of a motor and parts contacting it, heat generated from the motor can be discharged effectively and operating life of the motor can be improved.

Thus, the present invention is directed to provide an axial-flow fan having a structure capable of cooling effectively a rotary shaft of a motor.

A first aspect of the invention is an axial-flow fan including a fan motor 2 with a rotary shaft 1 projected at one end of a center, and a fan 6 having a bowl-like shaped boss part 4 to be fitted over an end part outer periphery on the rotary shaft 1 side of the fan motor 2 via a space 3 and having many fan blades 5 projected in a radial pattern on an outer periphery of the boss part 4, wherein:

a plurality of air holes 7 are formed in a shaft line direction of the rotary shaft 1, adjacently to the rotary shaft 1 and intensively in a central portion of the boss part 4;

a blade air current 8 generated in one direction of the shaft line by the many fan blades 5 is included;

a central portion air current 9 generated by discharging air passing through an inside of the space 3 in the other direction of the shaft line through the air hole 7 is included; and the rotary shaft 1 is to be cooled with the central portion air current 9.

A second aspect of the invention is the axial-flow fan according to the first aspect, wherein:

the fan 6 is composed of a resin molding, and, in the central portion of the boss part 4 thereof, a seat plate 10 made of metal is insert-molded orthogonally to the rotary shaft 1; and a plurality of the air holes 7 are formed in a central portion of the seat plate 10, and the rotary shaft 1 passes through the center of the seat plate 10.

a third aspect of the invention is the axial-flow fan according to the first or second aspect, wherein a cylindrical spacer 11 is fitted on an outer periphery of the rotary shaft 1, and the space 3 is formed between the fan motor 2 and the boss part 4 with the spacer 11.

According to the first aspect of the invention, the central portion air current 9 circulating in a direction opposite to the direction of the blade air current 8 of a fan is discharged through a plurality of air holes 7. The plurality of air holes 7 lie adjacent to the rotary shaft 1 and are gathered in the central portion of the boss part 4, to make it possible to cool effectively the rotary shaft 1 and the vicinity thereof with the central portion air current 9, and to suppress rise in temperature of a fan motor.

According to the second aspect of the invention, the seat plate 10 made of metal is insert-molded in a fan made of resin, orthogonally to the rotary shaft 1, and, in the central portion of the seat plate 10, a plurality of the air holes 7 are formed and a rotary shaft passes through the center of the seat plate 10.

Hereby, an axial-flow fan with high strength and high heat dissipation property is given.

According to the third aspect of the invention, the space 3 is formed between the fan motor 2 and the boss part 4 with the spacer 11, and the central portion air current 9 is guided thereto.

Hereby, the central portion air current 9 can be guided smoothly, and the heat dissipation property of a rotary shaft of the fan motor 2 and the vicinity thereof can be improved.

BRIEF DESCRIPTION OF THE DRAWINGS

FIG. 5A shows results of experiments for comparing rise in temperature in a case of a fan with many air holes 7 drilled in the seat plate 10 in FIG. 2, and in a case of a fan without the air hole 7.

FIGS. 5B and 5C show the fan without an air hole and the fan with many air holes, respectively.

DESCRIPTION OF THE EMBODIMENTS

Next, embodiments of the present invention will be explained on the basis of the drawings.

Figure 1:
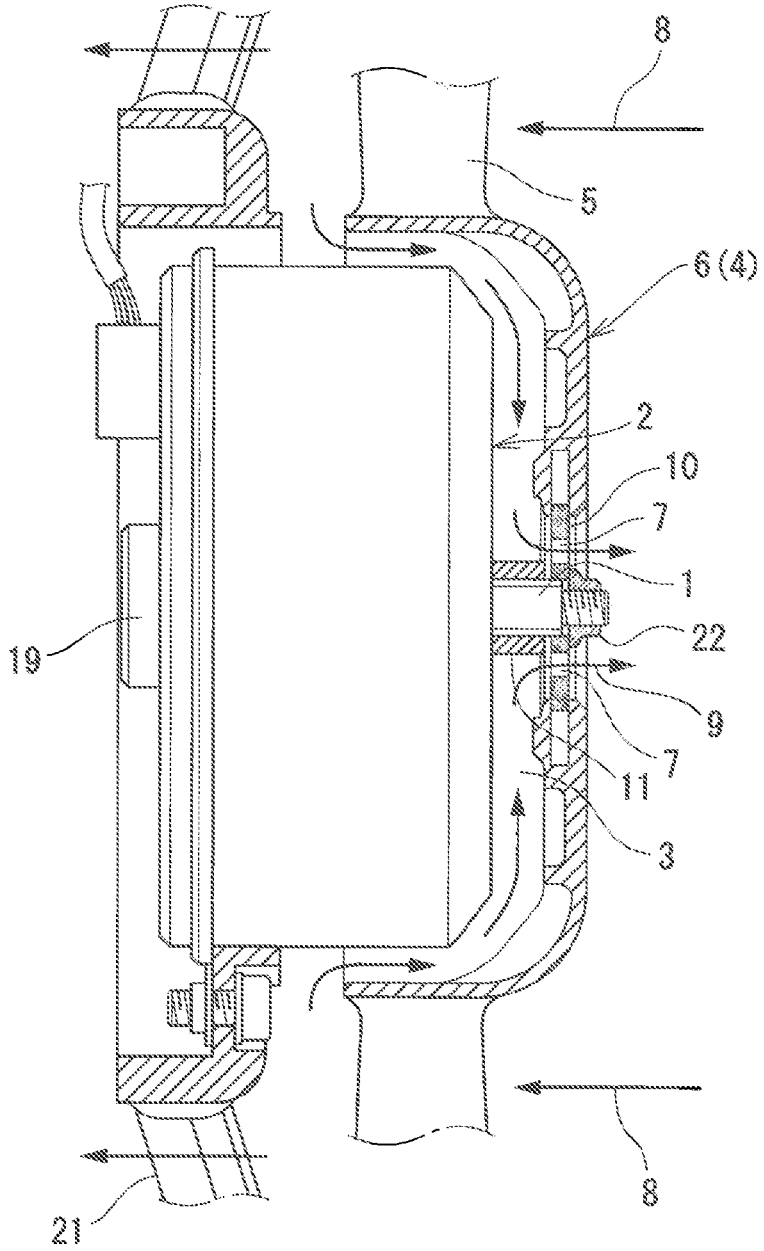
FIG. 1 illustrates a longitudinal cross-sectional view of a principal part of an axial-flow fan of the present invention.
Figure 2:
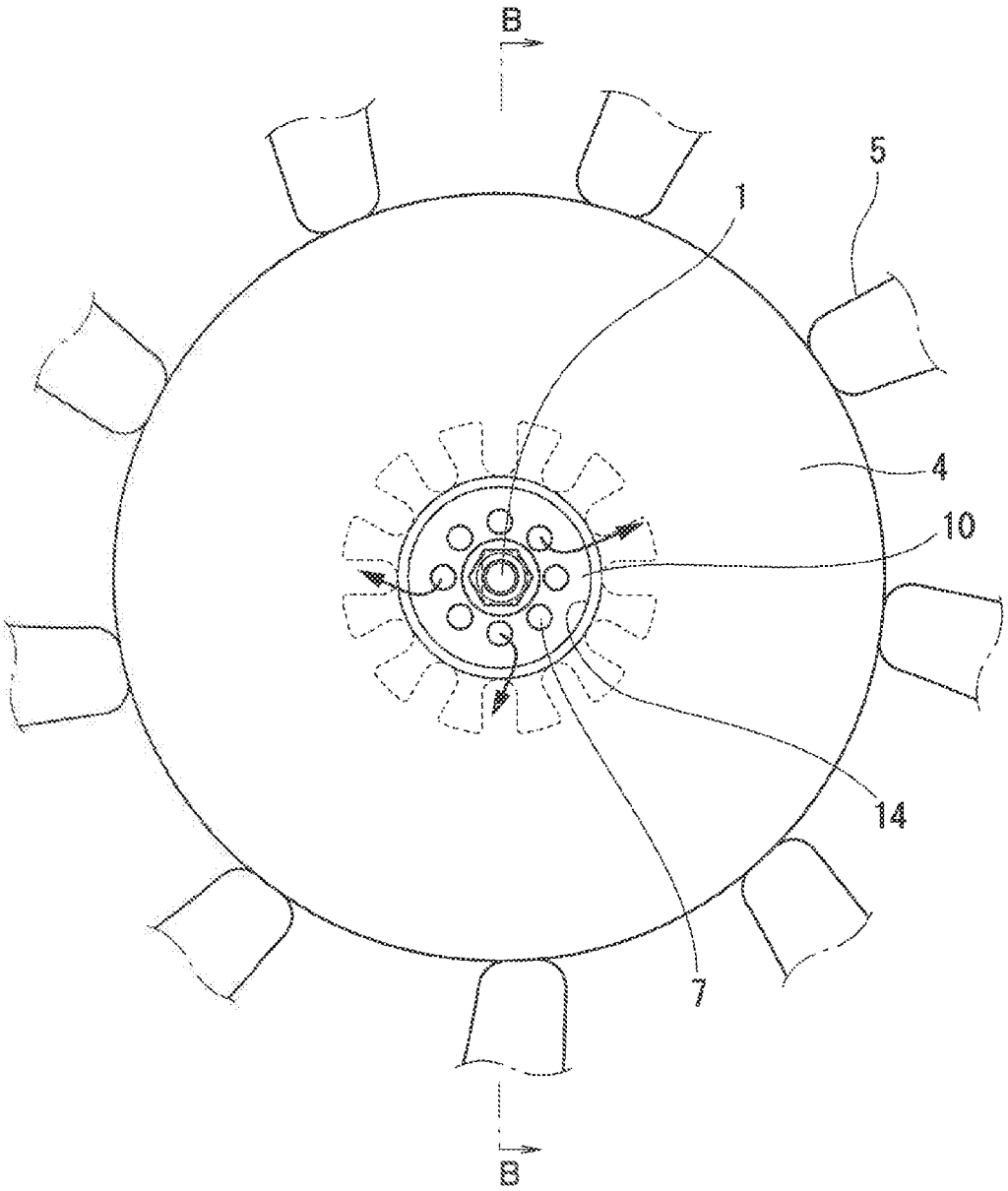
FIG. 2 illustrates a right side view of FIG. 1.
Figure 3A:
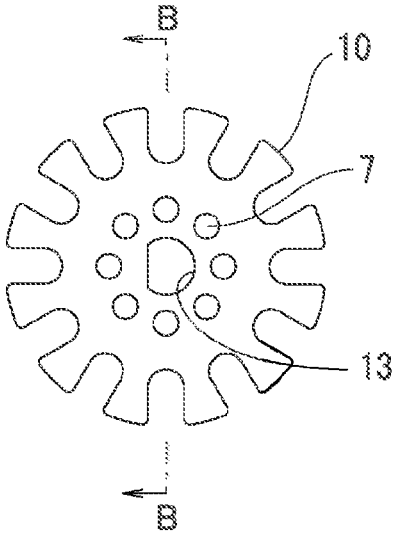
FIG. 3A illustrates a plan view of a seat plate 10 insert-formed in a central portion of the axial-flow fan.
Figure 3B:
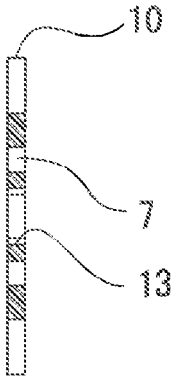
FIG. 3B illustrates a B-B arrow-seen cross-sectional view of FIG. 3A.

FIG. 1 illustrates a longitudinal cross-sectional view of a principal part of an axial-flow fan of the present invention, FIG. 2 illustrates a right side view of FIG. 1, and FIG. 3 illustrates a plan view and a B-B arrow-seen cross-sectional view of a seat plate 10 for use in the axial-flow fan. FIG. 4 illustrates a front view and a B-B arrow-seen cross-sectional view of a fan 6 for use in this axial-flow fan.

In this axial-flow fan, in FIG. 1, an arm 21 is in connection with a fixing member in a bonnet of a vehicle, and a shroud is provided for an outer periphery end of the arm 21. Furthermore, a fan motor 2 is attached to the arm 21 with a bolt.

In the fan motor 2, a rear end bearing 19 is provided at a rear end thereof, and, at a front end, a front end part of a rotary shaft 1 is projected through a front end bearing (not shown). Moreover, a spacer 11 is fitted on the outer periphery of the rotary shaft 1. Furthermore, to the rotary shaft 1, the fan 6 is fixed with a fastening bolt 22. The fan 6 is composed of a resin molding, has a bowl-like shaped boss part 4 and many fan blades 5 provided on the outer periphery thereof so as to project forward in a radial pattern, and the seat plate 10 buried in the center of the boss part 4.

In this seat plate 10, as shown in FIG. 3, a shaft hole 13 into which the rotary shaft 1 is inserted is formed in the center, and in this example eight air holes 7 are drilled around the center. Furthermore, many uneven parts are formed in a radial pattern on the outer periphery of the seat plate 10. As shown in FIG. 2, the uneven part is insert-formed in the resin of the boss part 4, and the center side from a burying edge 14 thereof is exposed. In the center of such seat plate 10, as shown in FIG. 1, the rotary shaft 1 penetrates, and the front end of the rotary shaft 1 is fixed with the fastening bolt 22.

Figure 4A:
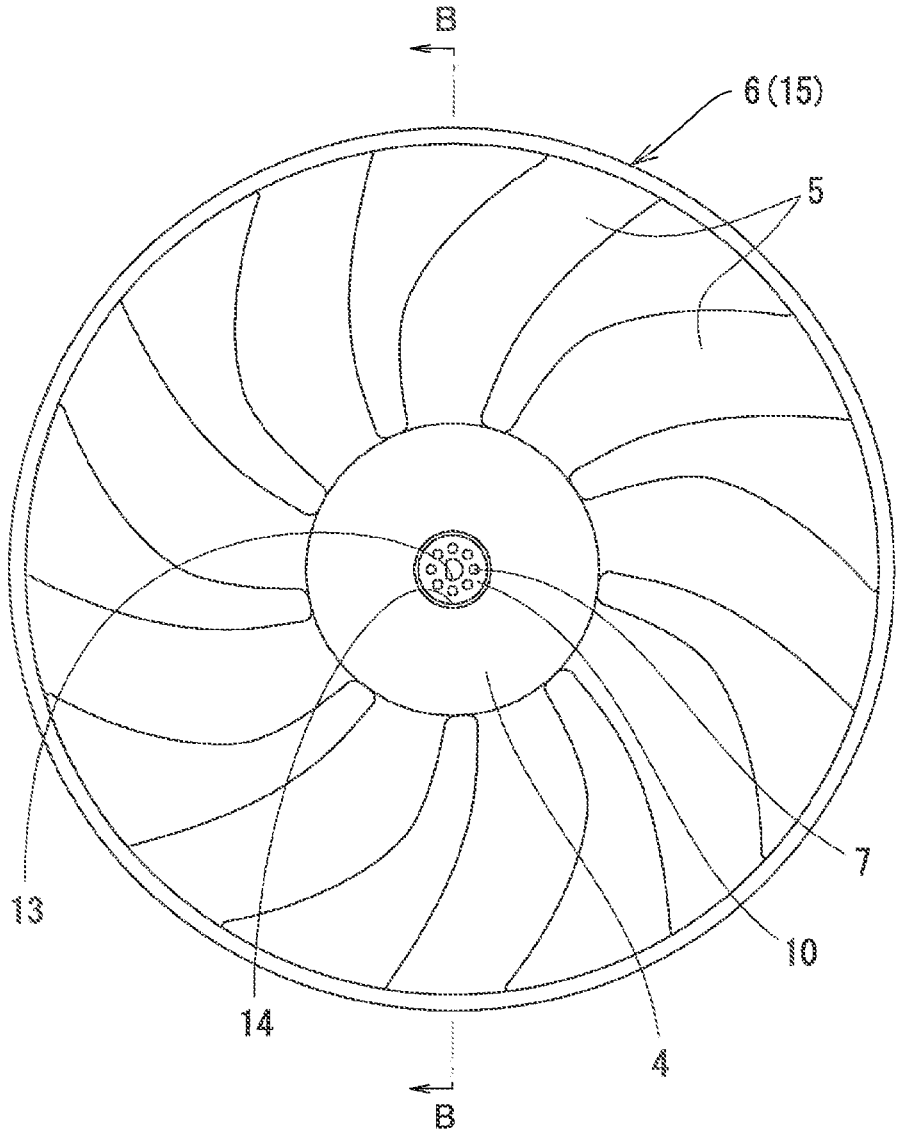
FIG. 4A illustrates a front view of a fan 6 for use in the axial-flow fan.
Figure 4B:
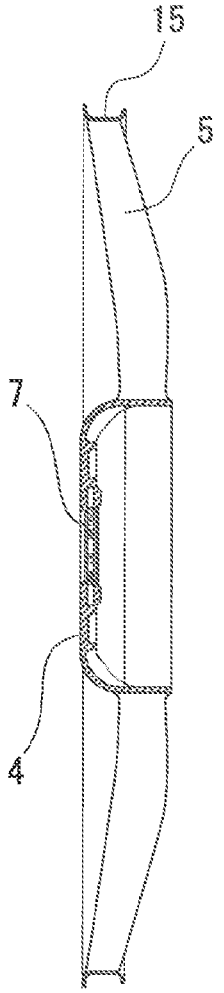
FIG. 4B illustrates a B-B arrow-seen cross-sectional view of FIG. 4A.

In the fan 6, as shown in FIGS. 4A, 4B, many fan blades 5 project in a radial pattern from the boss part 4 thereof, and spaces between respective front end parts are integrally interlinked with a ring 15. In this example, the ring 15 is formed in a shallow groove shape in a horizontal section, and a shroud (not shown) is fitted on the outside of the ring 15.

(Function)

Now, the characteristic of the present invention is the function of the seat plate 10 buried in the center of the fan 6, and many air holes 7 are drilled in the seat plate 10.

Then, when the rotary shaft 1 of the fan motor 2 rotates, many fan blades 5 provided on the outer periphery of the boss part 6 are driven, and, due to this, a blade air current 8 circulates from the right-hand side of the boss part 4 to the left-hand side in FIG. 1. Consequently, air is sent to a heat exchanger (not shown).

At this time, a central portion air current 9 is generated in a space 3 between the fan 6 and the fan motor 2. More specifically, the air lying between the fan motor 2 and the fan 6 is discharged from many air holes 7 of the seat plate 10. This is in a manner that, when the blade air current 8 is circulated from the right-hand side to the left-hand side by the fan blade 5, a negative pressure is generated in the boss part 4, and, due to this, the central portion air current 9 runs out through the air hole 7 from the left-hand side to the right-hand side.

Figure 6A:
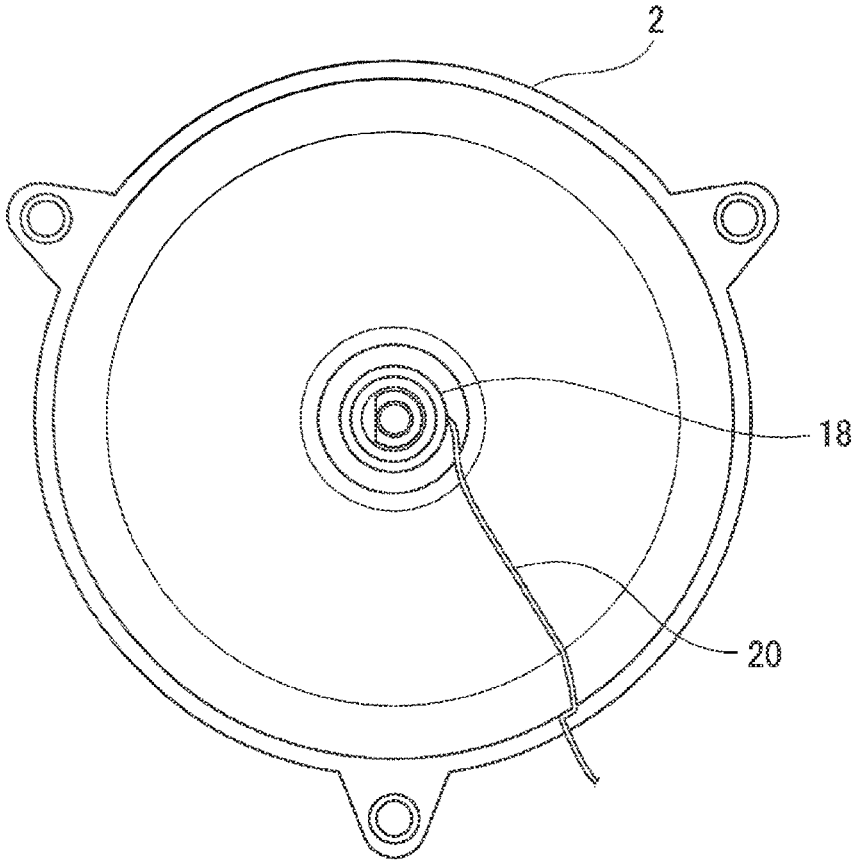
FIGS. 6A and 6B illustrate plan views of a front end bearing 18 (FIG. 6A) and a rear end bearing 19 (FIG. 6B) for which respective temperatures were measured in a fan in driving, in the experiments for comparison in FIG. 5.
Figure 6B:
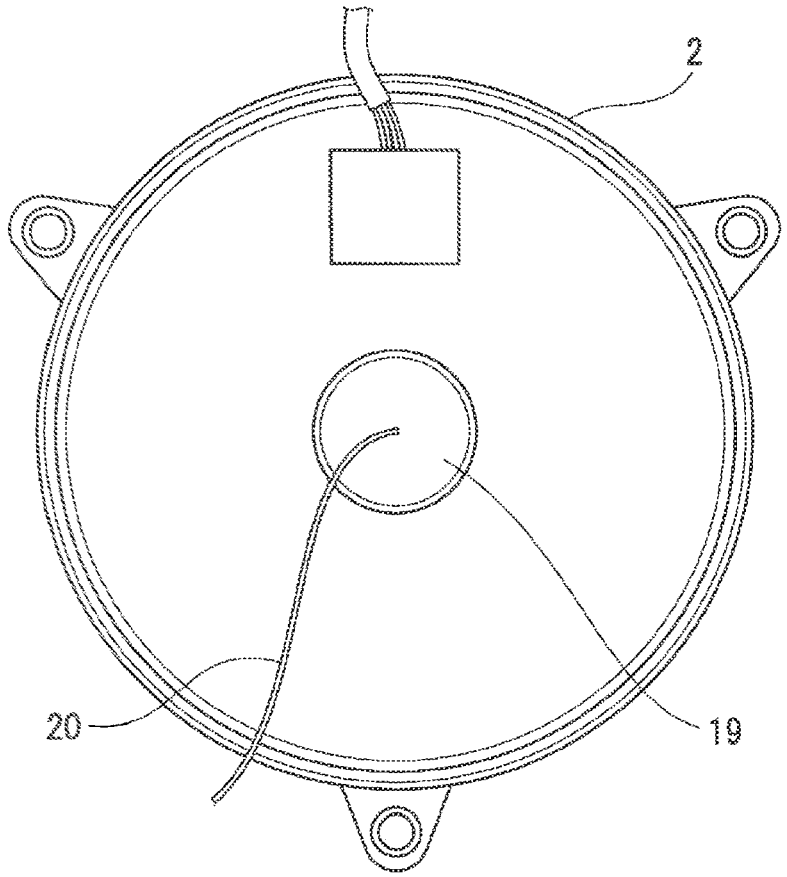

As a consequence of the circulation of the central portion air current 9 around the rotary shaft 1, the rotary shaft 1 is cooled, and a front end bearing 18 (FIG. 6A) and the rear end bearing 19 (FIG. 6B) shaft-supporting both ends of the rotary shaft 1 are cooled in the same way. Additionally, a brush 12 itself provided in the inside of the fan motor 2 illustrated in FIG. 7 is cooled.

FIG. 5A shows results of the degree of the cooling obtained experimentally.

In experiments, rise in temperature of each portion was compared between a case where the seat plate 10 having eight air holes 7 (FIG. 5C) was attached to a fan motor, as the present invention, and a case where a seat plate 16 without a hole not having the air hole 7 (FIG. 5B) was attached to a fan motor.

Figure 7:
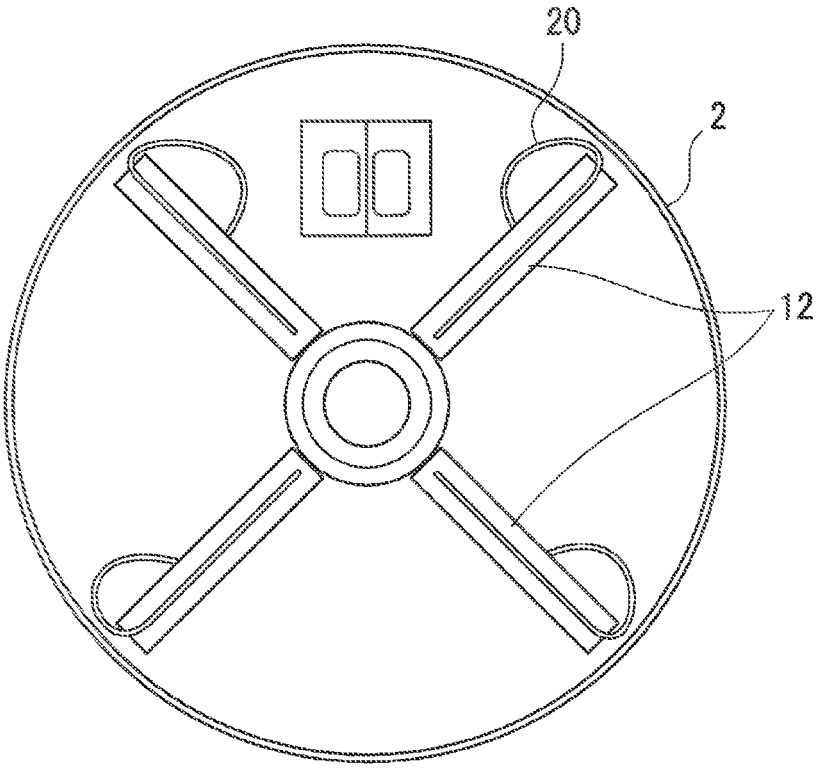
FIG. 7 illustrates a plan view showing respective positions of brushes 12 inside a fan motor in the experiment for comparison.

The upper table shows results of measuring respective temperatures of four brushes 12 in FIG. 7, and respective temperatures of the front end bearing 18 (FIG. 6A) and the rear end bearing 19 in (FIG. 6B), which are in contact with the rotary shaft 1, when the outer periphery temperature of the fan motor 2 is 80° C.

As the result, in a case of the seat plate 10 of the present invention having the air hole 7, temperature rise of each of brushes 12 was reduced by about 10° C. as compared with a case of the seat plate 16 without a hole, when the outer periphery temperature of the fan motor 2 was 80° C. Moreover, the front end bearing 18 supporting the rotary shaft 1 showed reduction in temperature rise of 10.7° C., and the rear end bearing 19 showed reduction in temperature rise of 8.1° C.

Next, when the outer periphery temperature of the fan motor 2 was 90° C., in the case of the seat plate 10 having the air hole 7 of the present invention, temperature rise in the brush 12 was reduced by about 6° C. as compared with the case of the seat plate 16 without a hole, and, in the case of the rotary shaft 1, the reduction in temperature rise in the front end bearing 18 was 7° C., and that in the rear end bearing 19 was 2.7° C.

These results have revealed that the rotary shaft 1, the front end bearing 18 and rear end bearing 19 that are in contact with it, and each of brushes 12 are cooled, in the case where many air holes 7 are drilled in the seat plate 10 lying in the central portion of the fan 6.

DESCRIPTION OF THE NUMERALS

1 rotary shaft
2 fan motor
3 space
4 boss part
5 fan blade
6 fan
7 air hole
8 blade air current
9 central portion air current
10 seat plate
11 spacer
12 brush
13 shaft hole
14 burying edge
15 ring
16 seat plate without a hole
18 front end bearing
19 rear end bearing
20 thermocouple output wire
21 arm
22 fastening bolt

What is claimed is:

1. An axial-flow fan comprising a fan motor with a rotary shaft projecting from a center of a face of the fan motor, and a fan having a bowl-like shaped boss part fitted onto an outer periphery of an end part of the rotary shaft with an annular space formed between the boss part and the fan motor and having a plurality of fan blades projecting radially from an outer periphery of the boss part, wherein:

a plurality of air holes is formed through a bottom wall of the boss part, the plurality of air holes being configured as a concentrated array in a central portion of the boss part adjacent the rotary shaft, faces of the boss part central portion being entirely planar and an axis of each of the air holes being entirely orthogonal to the faces of the boss part and parallel to an axis of the rotary shaft; and the fan blades are configured so as to generate an air current parallel to the axis of the rotary shaft and in a direction away from the face of the fan motor from which the rotary shaft projects and a negative air pressure at faces of the fan blades facing away from the face of the fan motor from which the rotary shaft projects; whereby the negative air pressure draws air from around an outer periphery of the boss part adjacent the faces of the fan blades facing away from the face of the fan motor from which the rotary shaft projects into the annular space and along the rotary shaft in a direction parallel to the axis of the rotary shaft toward the face of the fan motor from which the rotary shaft projects and out of the annular space through the air holes to carry heat from the rotary shaft and the motor directly away from the fan in a direction parallel to the axis of the rotary shaft.

2. The axial-flow fan according to claim 1, wherein:

the fan is composed of a resin molding, and the boss part comprises, in a central portion thereof, a seat plate made of metal insert-molded orthogonally to the rotary shaft; and the plurality of the air holes is formed in a central portion of the seat plate, and the rotary shaft passes through a center of the seat plate.

3. The axial-flow fan according to claim 2, further comprising a cylindrical spacer fitted on an outer periphery of the rotary shaft thereby to form the annular space between the fan motor and the boss part.

4. The axial-flow fan according to claim 1, further comprising a cylindrical spacer fitted on an outer periphery of the rotary shaft thereby to form the annular space between the fan motor and the boss part.

* * * * *